US010555623B2

(12) United States Patent
Kologe et al.

(10) Patent No.: US 10,555,623 B2
(45) Date of Patent: Feb. 11, 2020

(54) COMPACT DISPLAY TRAY

(71) Applicant: Trion Industries, Inc, Wilkes-Barre, PA (US)

(72) Inventors: Joseph F. Kologe, Scranton, PA (US); Marc D. Huntington, Berwick, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 16/230,163

(22) Filed: Dec. 21, 2018

(65) Prior Publication Data

US 2019/0200782 A1 Jul. 4, 2019

Related U.S. Application Data

(60) Provisional application No. 62/613,221, filed on Jan. 3, 2018.

(51) Int. Cl.

| | |
|---|---|
| ***A47F 1/12*** | (2006.01) |
| ***A47F 5/00*** | (2006.01) |
| ***A47F 7/00*** | (2006.01) |
| ***A47B 57/58*** | (2006.01) |
| *A47F 7/28* | (2006.01) |

(52) U.S. Cl.

CPC ..... *A47F 1/125* (2013.01); *A47B 57/58* (2013.01); *A47F 5/005* (2013.01); *A47F 7/0007* (2013.01); *A47F 7/0071* (2013.01); *A47F 7/28* (2013.01)

(58) Field of Classification Search

CPC ..... A47F 1/125; A47F 1/126; A47F 5/005; A47F 7/0071; A47F 7/0007; A47F 7/28; A47B 57/58

USPC ..... 211/184, 59.2, 59.3, 59.4, 189, 74; 312/61, 71; 108/61

See application file for complete search history.

(56) References Cited

U.S. PATENT DOCUMENTS

| | | | | |
|---|---|---|---|---|
| 4,724,968 A * | 2/1988 | Wombacher | A47F 5/005 | 211/184 |
| 4,830,201 A * | 5/1989 | Breslow | A47F 1/126 | 211/184 |
| 4,901,869 A * | 2/1990 | Hawkinson | A47F 1/126 | 211/184 |
| 5,046,789 A * | 9/1991 | Lee | A47B 87/0276 | 312/108 |

(Continued)

*Primary Examiner* — Jonathan Liu
*Assistant Examiner* — Devin K Barnett
(74) *Attorney, Agent, or Firm* — St. Onge Steward Johnston & Reens, LLC

(57) ABSTRACT

A tray for dispensing product containers, particularly yogurt containers, which vary widely in size and shape and frequently are stacked several high. The tray is of adjustable width and of extruded construction. The tray comprises two main components, one forming a bottom part and a high wall, the other forming a bottom part and a low wall. The high wall has a flanged track running lengthwise and the low wall has a T-shaped rail for reception in the flanged track of an adjacent tray. An array of trays are thus connected such that the high wall of one tray serves as a second high wall for an adjacent connected tray while allowing a tray to be pulled forward, supported by its neighbors, for restocking. A pusher and pull strip are provided in which an L-shaped pusher can be reversely oriented and thereby optimized for round or rectangular containers.

13 Claims, 10 Drawing Sheets

(56) References Cited

U.S. PATENT DOCUMENTS 5,199,584 A * 4/1993 Fowler ..... A47F 5/0043 211/184
5,366,099 A * 11/1994 Schmid ..... A47F 1/126 211/175
5,634,564 A * 6/1997 Spamer ..... A47F 1/126 211/59.3
5,638,963 A * 6/1997 Finnelly ..... A47F 1/125 211/59.3
5,775,046 A * 7/1998 Fanger ..... A47B 81/06 108/157.16
6,129,218 A * 10/2000 Henry ..... A47F 1/126 211/59.3
6,227,385 B1 * 5/2001 Nickerson ..... A47F 1/126 108/61
6,311,852 B1 * 11/2001 Ireland ..... A47F 1/12 211/184
6,585,120 B2 * 7/2003 Robertson ..... A47F 1/12 211/59.2
6,622,874 B1 * 9/2003 Hawkinson ..... A47F 1/126 211/175
6,695,152 B1 * 2/2004 Fabrizio ..... A47F 1/12 211/175
6,886,700 B2 * 5/2005 Nagel ..... A47F 1/126 211/184
7,124,898 B2 * 10/2006 Richter ..... A47F 1/12 211/59.3
7,500,571 B2 * 3/2009 Hawkinson ..... A47F 1/126 211/59.3
7,631,771 B2 12/2009 Nagel et al.
8,820,545 B2 * 9/2014 Kologe ..... A47F 5/0025 211/59.3
8,893,903 B2 * 11/2014 Nilsson ..... A47B 57/588 211/134
9,103,580 B2 * 8/2015 Bryson ..... A47F 5/10
9,392,883 B2 * 7/2016 Kologe ..... A47F 1/125
9,445,675 B1 * 9/2016 DeSena ..... A47F 1/126
9,532,662 B2 * 1/2017 Desmond ..... A47B 96/021
9,955,802 B2 * 5/2018 Bird ..... A47F 1/125
2002/0170866 A1 * 11/2002 Johnson ..... A47F 1/126 211/59.3
2003/0057167 A1 * 3/2003 Johnson ..... A47F 1/126 211/59.3
2003/0057221 A1 * 3/2003 Guillemette ..... A47K 10/426 221/45
2003/0085187 A1 * 5/2003 Johnson ..... A47F 1/126 211/59.3
2005/0139560 A1 * 6/2005 Whiteside ..... A47B 57/586 211/119.003
2005/0166806 A1 * 8/2005 Hardy ..... A47F 1/126 108/61
2005/0189310 A1 * 9/2005 Richter ..... A47F 1/12 211/59.3
2005/0263473 A1 * 12/2005 TenBrink ..... A47B 45/00 211/189
2006/0283819 A1 * 12/2006 Larsen ..... A47F 1/12 211/59.2
2007/0075028 A1 * 4/2007 Nagel ..... A47F 3/0486 211/59.2
2007/0158281 A1 * 7/2007 Hardy ..... A47F 1/126 211/59.3
2008/0011696 A1 * 1/2008 Richter ..... A47F 1/126 211/59.2
2008/0156752 A1 * 7/2008 Bryson ..... A47F 1/126 211/59.3
2008/0203256 A1 * 8/2008 Medcalf ..... A47F 1/126 248/231.81
2009/0302725 A1 * 12/2009 Rogers ..... A47B 47/042 312/257.1
2010/0078402 A1 * 4/2010 Davis ..... A47B 57/585 211/184
2010/0258513 A1 * 10/2010 Meyer ..... A47F 1/126 211/59.3
2011/0174750 A1 * 7/2011 Poulokefalos ..... A47F 1/126 211/59.3
2012/0228242 A1 * 9/2012 Vogler ..... A47F 1/06 211/4
2013/0037498 A1 * 2/2013 Kao ..... A47F 5/0838 211/59.2
2014/0299560 A1 * 10/2014 Kim ..... A47F 1/126 211/59.2
2016/0150894 A1 * 6/2016 Howard ..... A47F 1/126 211/59.3
2017/0164762 A1 * 6/2017 Bryson ..... A47F 5/0025
2019/0110610 A1 * 4/2019 Kologe ..... A47F 1/126

* cited by examiner

COMPACT DISPLAY TRAY

FIELD OF THE INVENTION

The invention relates to trays utilized in stores and supermarkets to enable products to be maintained in neat and orderly rows on the store shelves and to enable the products to be "fronted" so that the products are visible and easily removed from the trays by a customer. The invention is particularly directed to the display and dispensing of yogurt containers or the like, which are presented in a wide variety of sizes and shapes, which present problems to storekeepers in properly and efficiently displaying the products.

BACKGROUND OF THE INVENTION

The display and dispensing of yogurt containers has presented significant problems to the store owner due to the often irregular shape of the containers and to the fact that they are frequently stacked three and four high in their dispensing trays. An initial solution was provided by a special injection molded, width-adjustable yogurt tray described and claimed in U.S. Pat. No. 7,631,771 of Trion Industries, Inc., the assignee of this application. Over time, however, yogurt companies began to provide yogurt in an even larger variety of container sizes and shapes, requiring the molded trays to be provided in multiple sizes, which was both inconvenient and uneconomical.

SUMMARY OF THE INVENTION

The present invention is directed to an improved and economical, adjustable width tray for the display and dispensing of yogurt containers in a wide variety of sizes and shapes, typically stacked in several tiers, one container on top of another. The primary parts of the trays are of inexpensive, extruded construction, enabling a low cost, highly versatile tray to be provided for the display of yogurt and similar products.

In accordance with one aspect of the invention, individual trays are provided with one high side wall and one low side wall. The high side wall is of a height to provide lateral confinement for a plurality of product containers, stacked in multiple tiers. The low side wall, on the other hand, is of a height which preferably is less than the height of a single container. The individual trays, however, are provided with interlocking connections between the low side walls and high side walls, such that the high side wall of a first tray can be connected to the low side wall of an adjacent second tray. With this arrangement, the high side wall of the first tray serves the function of a second high side wall of the second tray, such that tier-stacked products of the second tray are properly confined on both sides.

Yogurt containers predominantly, although not exclusively, are configured to be wider at the top than at the bottom, with many having an overhanging lip or lid. To particular advantage, in the system of the invention, the adjustable width trays can in many cases be set to a width such that the lips of the bottom containers can overhang the top of the low side wall. In such cases, the presence of the low side walls does not add to the overall width of an assembly of such trays disposed over the full width of a store shelf. Such small savings in width in individual trays can be of great significance to a store keeper in that it may allow the store keeper to add an additional tray to a particular full-width shelf display.

In a particularly preferred embodiment of the invention, the respective short and high side walls of a tray are provided with longitudinally extending, interengaging rails and tracks which secure adjacent trays together while allowing individual trays to be pulled forward relative to their neighboring trays, to facilitate servicing, such as restocking. To advantage, the low side wall may have a T-shaped rail extending longitudinally adjacent a lower edge thereof while the high side wall may have adjacent its lower edge a recessed track comprised of opposed flanges which slidably engage the T-shaped rail of an adjacent tray. The spacing between the opposed flanges is sufficiently greater than the vertical dimensions of the T-shaped rail, such that the front of an individual tray may be lifted somewhat (e.g., $\frac{1}{4}^{th}$ inch) in relation to adjacent trays, to allow a tray to be lifted over a retaining rail, frequently installed at the front of the shelf, when pulling the tray forward for servicing. The interengaging rails and tracks also provide support for a tray that is pulled out for servicing.

Providing a low side wall at one side of the tray simplifies and expedites servicing and restocking of the trays. When a particular tray is pulled forward, one side of the tray is open and readily accessible from the side of the low wall.

In a preferred form of the invention, each tray is provided with a manually operated pusher, which is mounted for sliding movement on a longitudinal track preferably formed on the high side wall of the tray. A pull strip is received and guided in the pusher track and is attached at its remote end to the pusher. In accordance with an aspect of the invention, the tray may be provided with a novel form of reversible pusher which is provided with track-engaging means adjacent the top and bottom of the pusher. Each of the track-engaging means has an element for connecting to the pull strip. The pusher is of a generally L-shaped configuration, viewed vertically, with arcuate contours between the two legs of the "L". In one orientation, a side wall of the pusher, which is the short leg of the "L", extends forward, which is suitable for round or rounded containers. For square containers, the pusher can be detached from its pull strip, reoriented by rotation about a transverse horizontal axis and re-attached to the pusher track and pull strip. In the new orientation, the pusher presents a forwardly facing flat surface for engagement with a flat edge or side of a squared product container.

The trays of the invention can also incorporate an advantageous form of clip attachment at the front, which serve multiple functions as a product stop, price tag holder and limit stop to prevent overextension of trays being pulled forward for servicing.

For a more complete understanding of the above and other features and advantages of the invention, reference should be made to the following detailed description of preferred embodiments of the invention and to the accompanying drawings.

DETAILED DESCRIPTION OF THE INVENTION

Figure 1:
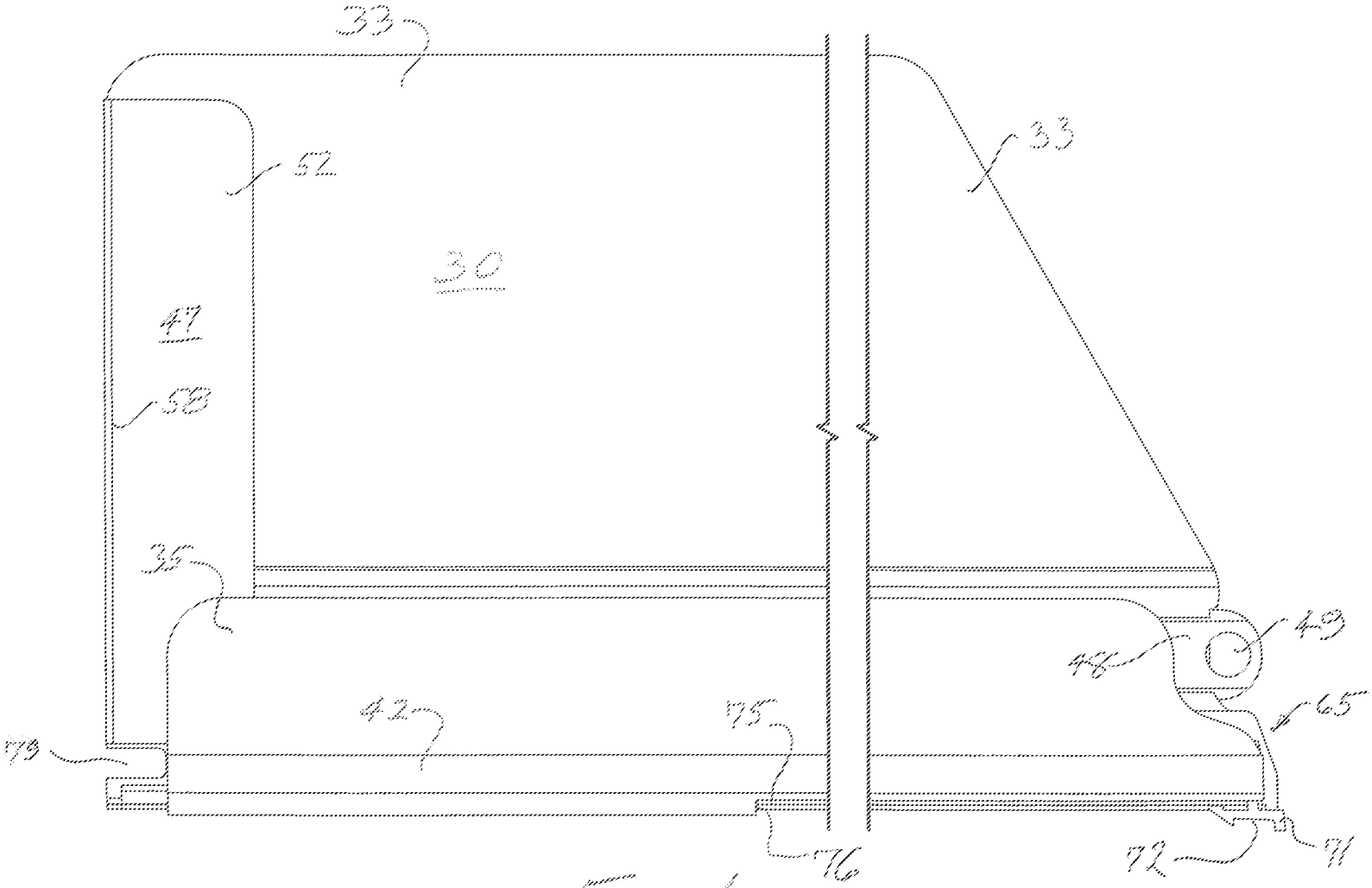
FIG. 1 is a side elevational view of a product display tray according to the invention

Referring to the drawings, and initially to FIGS. 1-6 thereof, the reference numeral 30 designates generally a single tray according to the invention. The tray includes first and second extruded components 31, 32, each of generally L-shaped cross section. The first component 31 forms a high side wall 33 of vertical orientation and a horizontal first bottom-forming part 34. The second component 32 forms a low side wall 35 and a second bottom-forming part 36. The high side wall 33 is intended to provide lateral confinement for product containers is several tiers, one container atop the other, and may suitably be about 6.25 inches in height measured from the bottom. The low side wall is intended to confine only one tier of products and preferentially is of a height at least slightly less than the height of the top of a container having a lip or lid, where the maximum lateral dimensions of the container are determined by the top. In one advantageous form of the invention, the low side wall 35 may have a height of about 1.82 inches, measured from the bottom. In keeping with an intent of the invention, the height of the low side wall should be no higher than slightly underneath the lip of small containers. Typically this may mean a maximum height of about two inches from the surface of the tray bottom. The product-supporting tray bottom in the illustrated system is formed by the second or upper bottom-forming part 36 and in particular by the tops of ribs 44 formed thereon.

Figures 2, 3:
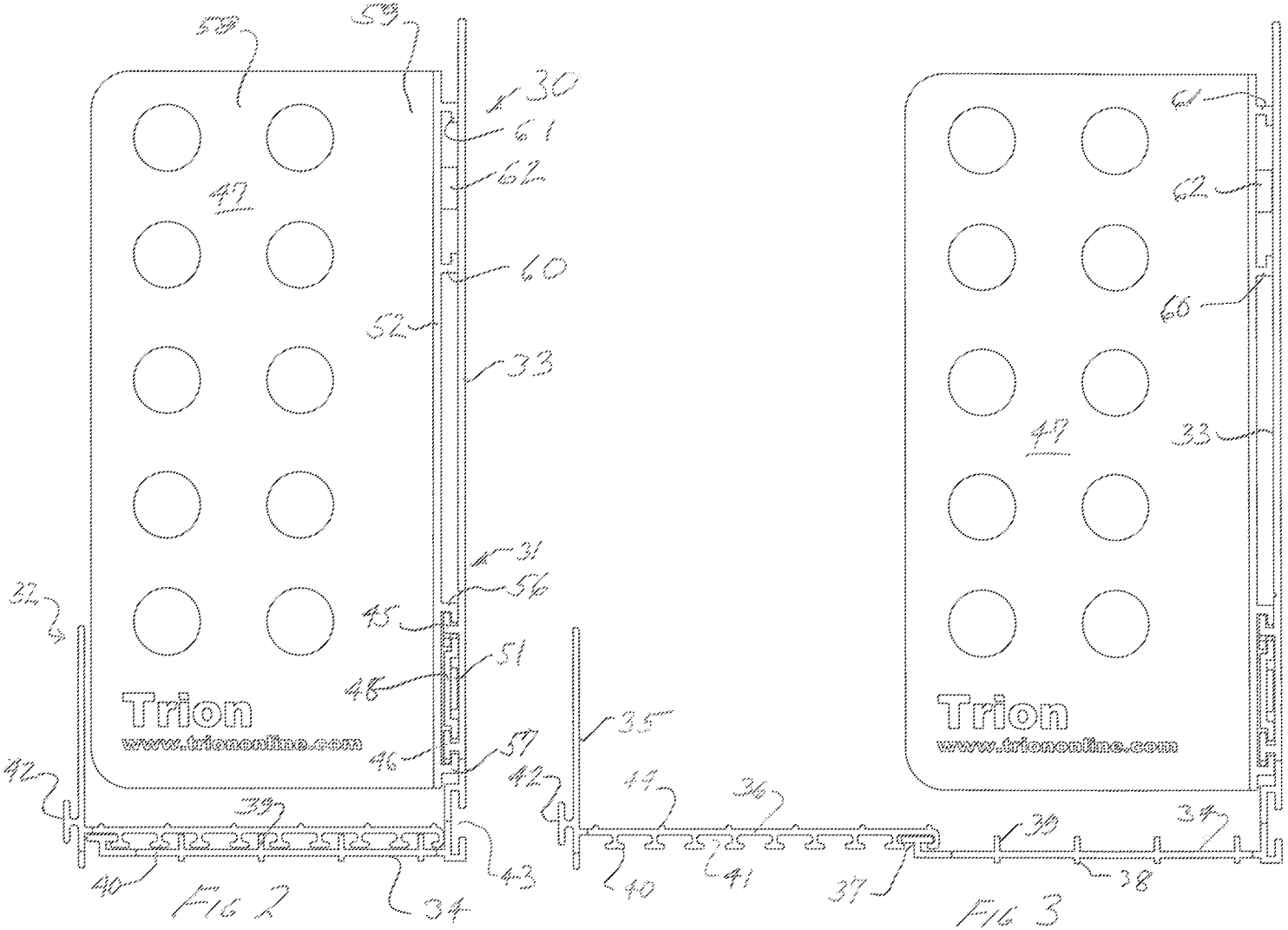
FIG. 2 is a front elevational view of the tray of FIG. 1, showing the tray in a minimum width adjusted position.
FIG. 3 is a front elevational view of the tray of FIG. 1, showing the tray in a maximum width adjusted position.

As indicated in FIGS. 2 and 3, the lower bottom-forming part 34 associated with the high side wall 33 is positioned below the upper bottom-forming part 36 associated with the low side wall 35. The bottom-part 34 extends laterally from the high side wall 33 a distance which may be about 2.85 inches, terminating in an upwardly projecting, T-shaped connector 37 which extends the length of the component 31. The bottom-forming part 34 also has short ribs 38 extending downward for engagement with the surface of a shelf. A second set of ribs 39 extends upward to engage and support the second bottom-forming part 36, as can be seen in FIG. 2. The second bottom-forming part 36 is formed with a plurality of downwardly projecting, longitudinally extending T-shaped elements 40 which are configured and spaced to form a plurality of downwardly opening flanged grooves 41 of a size and shape to slidably receive the T-shaped connector 37. As can be derived from FIGS. 1 and 2, the spacing between the tray side walls 33, 35 can be varied over a range of sizes depending upon the particular groove 41 in which the connector 37 is received.

Figure 5:
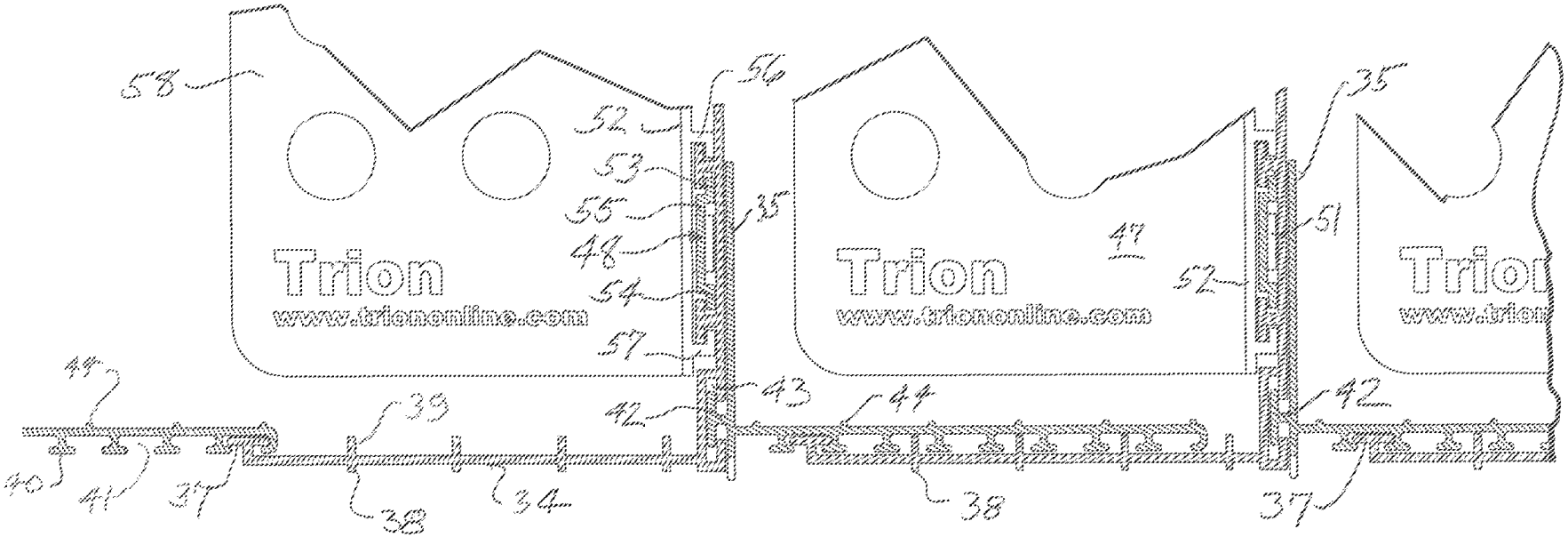
FIG. 5 is a cross sectional view illustrating a plurality trays connected together in side-by-side relation.

Pursuant to the invention, a rail 42, preferably of T-shaped configuration, extends longitudinally along one of the side walls 33, 35, preferably the low side wall 35. On the opposite side wall, preferably the high side wall 3, at the bottom thereof, there is a flanged track 43 configured to slidably receive the rail 42 (see FIG. 5). This enables a plurality of trays 30 to by joined in a side-by-side arrangement, extending if desired across the full width of a store shelf, while allowing a particular tray to be pulled forward from the rest for restocking or other servicing. In many store setups, there is a short guide rail (not shown) at the front of a shelf to align the fronts of the trays in a neat order. To pull an individual tray forward, it needs to be first lifted slightly at the front end to clear the guide rail. For this purpose, the flanged track 43 is of greater height than the T-shaped rail 42 received within it, as shown in FIG. 5, in order to allow a selected tray to be lifted in relation to its neighbors on either side. Typically, a lift of about one-fourth inch is sufficient to clear a guide rail, and the T-shaped rail 42 and flanged track 43 are dimensioned accordingly.

Figure 13:
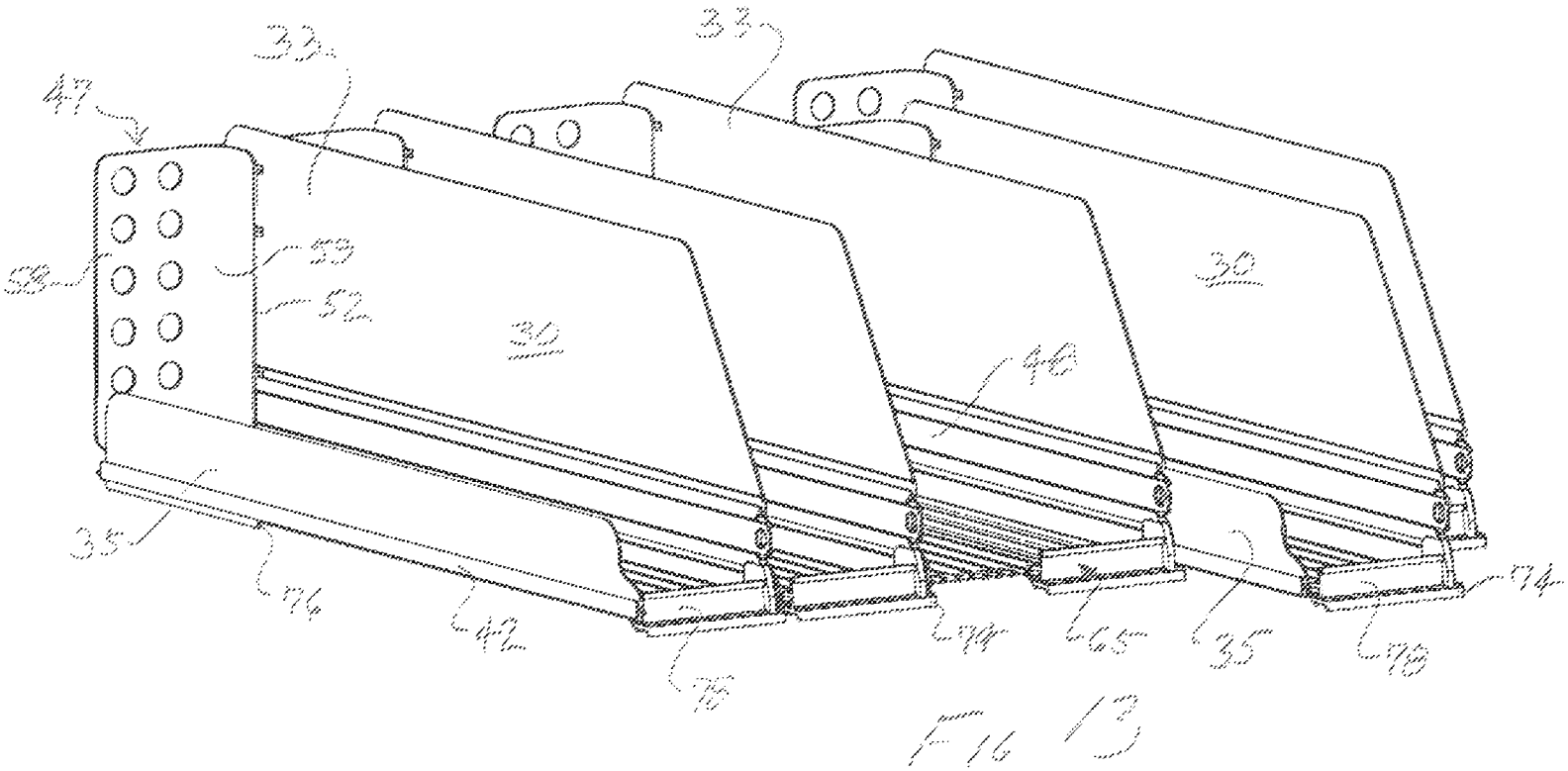
FIG. 13 is an orthographic view from the front of an assembly of several trays according to the invention, illustrating one of the trays in a forwardly displaced position.

As reflect in FIG. 13, when one of the trays 30 is pulled forward for restocking or other servicing, the low side wall 35 completely opens up one side of the tray and greatly facilitates manual access to the tray for inserting products, cleaning, etc. In this respect, it will be understood that a specific tray may be pulled outward to a much greater extent than is illustrated in FIG. 13, since the arrangement of rail 42 and flanged track 43 results in the other trays collectively providing significant cantilever support for a pulled-out tray.

Referring still to FIGS. 1-5 the high side wall 33 is provided on its inside, directly above the flanged track 43, with a pair of vertically spaced, longitudinally extending T-shaped rails 45, 46. The two rails 45, 46 form a pair of outwardly facing (i.e., one upwardly and one downwardly) grooves as well as a pair of inwardly facing grooves. The outward facing grooves of the rails 45, 46 engage with inwardly directed L-shaped mounting flanges 56, 57 formed at the bottom of a product pusher 47, enabling the pusher to be supported above the upper bottom-forming part 36 and moved forwardly and rearwardly in the tray. An elongated pull strip 48 is slidably received in opposed, inwardly facing grooves of the rails 45, 46. The pull strip has a finger opening 49 at its front end and a second opening 50 (FIG. 4) at its back end for engagement with a connector element 51 which extends laterally outward from the side wall 52 of the product pusher 47. Preferably, the pull strip 48 has upper and lower flanges 53, 54 which are offset slightly outward from the central body 55 of the strip, such that the body of the strip is more effectively positioned on the connector element 52, offset inward from its outer end. This can be seen in FIGS. 2, 3 and 5.

In the illustrations of FIGS. 1-9, the pusher 47 is oriented with its side wall 52 projecting forward from a flat transverse wall 58 thereof. A curved wall 59 joins the side wall 52 with the transverse wall 58. Where the containers to be displayed are of a squared configuration, the curved wall, which is desired for structural purposes, will tend to engage the squared container unevenly, tending to rotate it slightly, potentially jamming the container in the tray when the pusher is moved forward by the pull strip 48. Accordingly, as a feature of the invention, the pusher 47 is provided with a second set of inwardly directed L-shaped flanges 60, 61 symmetrically positioned in relation to the flanges 56, 57. In order to present a flat, front-facing surface to a squared container, the pusher 47 is withdrawn from the rear of the tray and disconnected from the pull strip 48. The pusher is then rotated end-for end (i.e., about a transverse horizontal axis) such that the side wall 52 projects to the rear. The flanges 60, 61, at the opposite end of the pusher, are engaged with the rails 45, 46, and the pull strip 48 is engaged with a connector element 62 located between the flanges 60, 61. The functions and operations of the pusher and pull strip are the same in either orientation of the pusher.

The "reverse" orientation of the pusher, described in the preceding paragraph, will function satisfactorily with rounded containers as with squared containers. However, when the side wall 52 of the pusher is projecting forwardly, the pusher may be positioned farther back in the tray and thus potentially provide room for additional products. Accordingly, for the display of rounded containers it is preferred to have the pusher in its "normal" orientation, with the side wall 52 extending forward, as in FIGS. 7-9.

Figure 9:
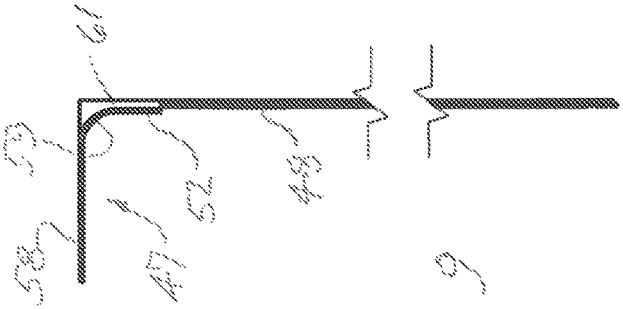
FIGS. 7, 8 and 9 are, respectively, an orthographic view, a front elevation, and a top plan view of a product pusher and pull strip according to the invention, oriented with a contoured surface of the pusher facing forward for use in connection with packages of circular and similar configuration.
Figure 8:
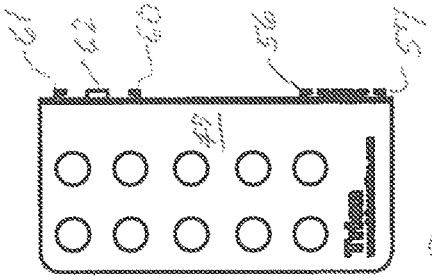
Figure 7:
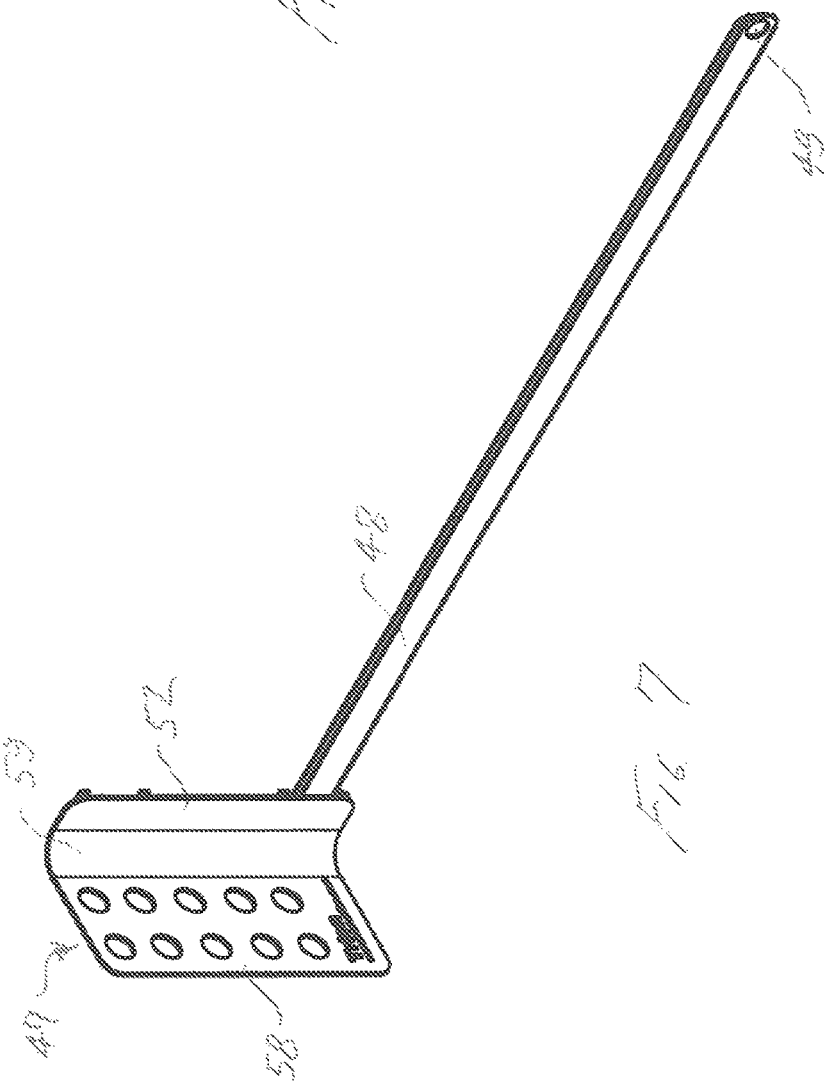
Figure 12:
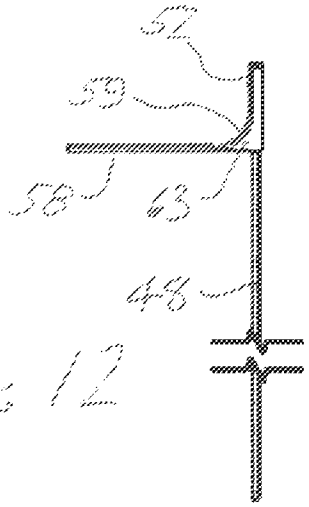
FIGS. 10, 11 and 12 are, respectively, an orthographic view, a front elevation, and a top plan view of a product pusher and pull strip according to the invention, oriented with a flat surface of the pusher facing forward for use in connection with packages of square and similar configuration.
Figure 11:
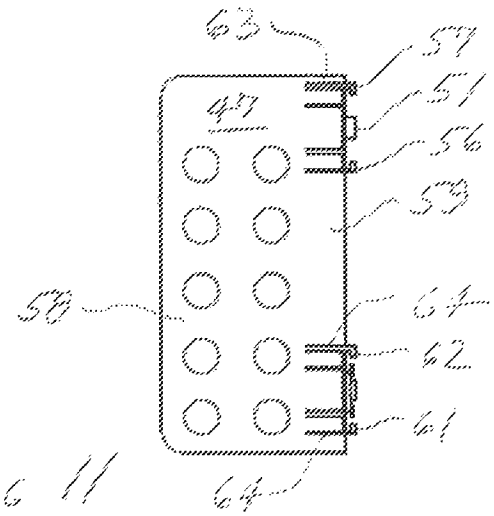
Figure 10:
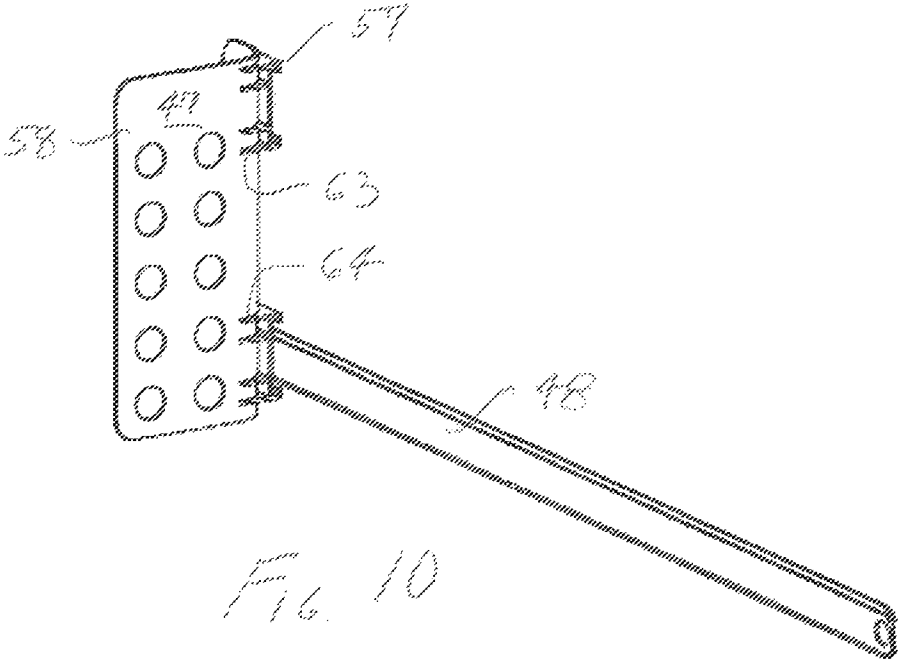

As indicated particularly in FIGS. 9-11, the pairs of mounting flanges 56, 57 and 60, 61 on the pusher 47 extend from the edge of the side wall 52 to the plane of the "back" side of the transverse pusher wall 58. To provide support for the mounting flanges, and to strengthen the connection between the transverse wall 58 relative to the side wall 52, pairs of reinforcing ribs 63, 64 (FIGS. 10-12) are formed at the "back" of the pusher and extend around the curved wall 59.

Figure 4:
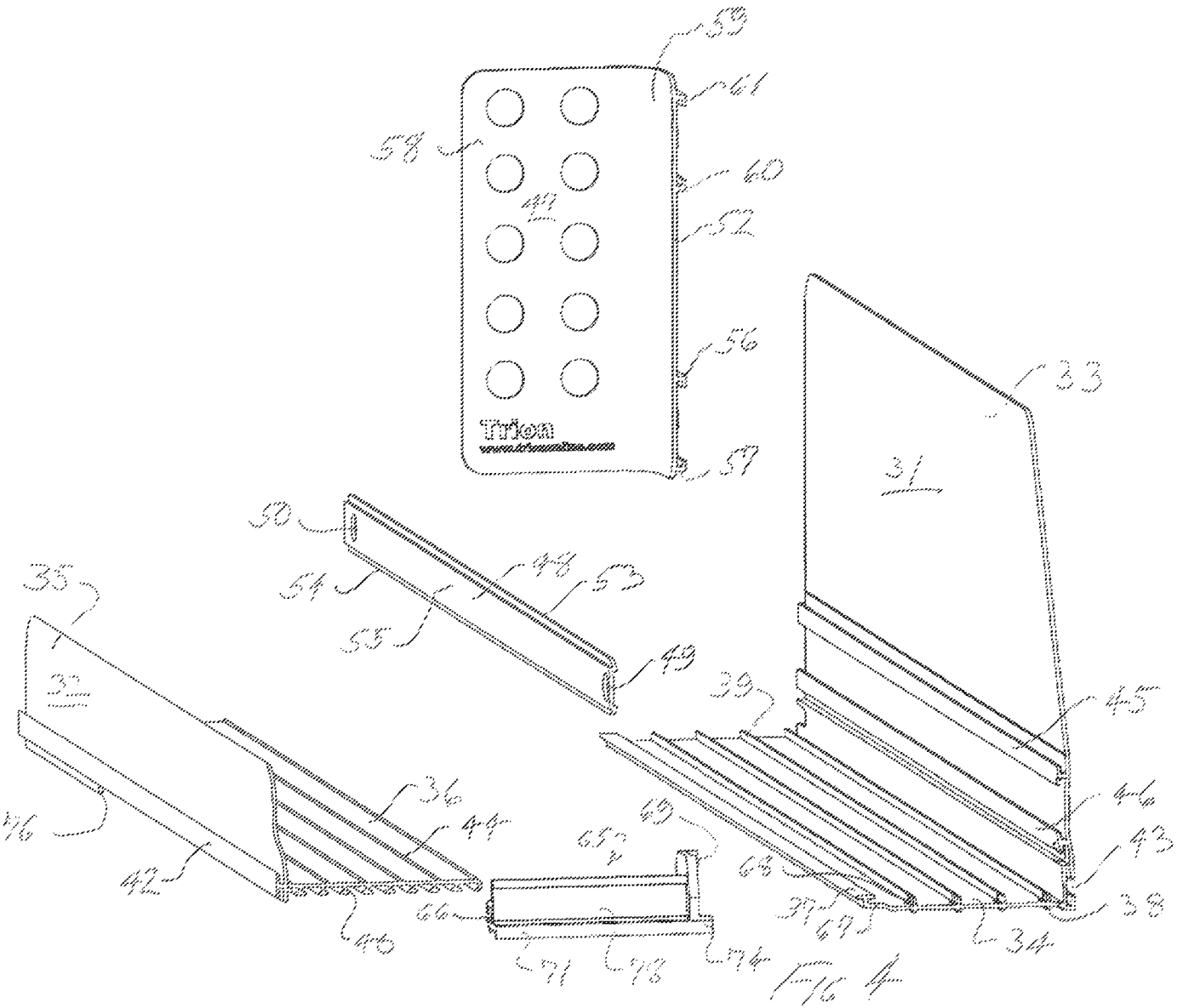
FIG. 4 is an exploded view of the tray of FIG. 1
Figure 17:
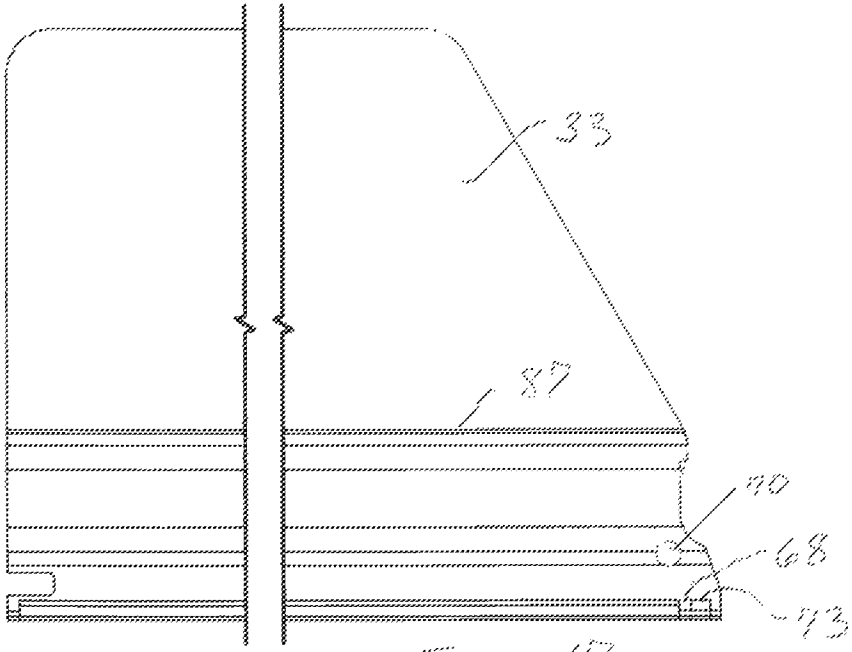

In the illustrated form of the invention, a front clip 65 is provided, which is secured to the front of first bottom-forming part 34, performing multiple functions. With reference to FIG. 4, the clip 65 has a rearwardly opening slot 66 which extends for the full width of the clip and allows the clip to be applied laterally, left to right, over the front of the bottom-forming part 34. To receive the clip, a recess 67 is cut into the front corner of the part 34 removing a front part of the T-shaped connector 37. Additionally, a transverse slot 68 is formed through the front portions of the upstanding ribs 39 to receive portions of the clip 65 that are above the slot 66 therein. A similar slot (not shown) is formed in the ribs 38 on the underside of the bottom-forming part 34. Residual front portions 73 of the ribs 39 (FIG. 17), and similar residual portions of the underneath ribs 38 prevent the clip from movement in any direction but laterally. The slot 66 of the clip is vertically enlarged behind the entrance opening thereof in order to accommodate the residual front portions of the ribs. A front portion of the second bottom-forming part 36 is recessed relative to a front edge of the low side wall 35 to allow for the presence of the installed clip 65 when the assembly is completed.

When the clip 65 is fully received on the bottom-forming part 34, a circular projection 69 at the right side of the clip is received in an opening 70 in the lower portion of the first component 31 (FIG. 17) to secure the right side of the clip. The bottom 71 of the clip 65 extends slightly below the bottoms of the side walls 33, 35 (FIG. 1) and thus slightly elevates the fronts of the trays 30. Preferably, the clip has a downwardly opening transverse recess 72 in its bottom which may be used for the reception of a front guide rail 77 (FIG. 15), if provided, at the front of a store shelf.

Among the functions of the clip 65, one is to serve as a forward product stop, when products are pulled forward by the pusher 47 and pull strip 48. As can be seen in FIG. 13 (center tray) when a tray is adjusted to a width that is wider than minimum, the clip 65 extends only part way across the front of the tray. However, part way is sufficient, particularly as the pusher 47 is of a width corresponding to that of the clip 65 and is aligned on the same side of the tray.

Figure 6:
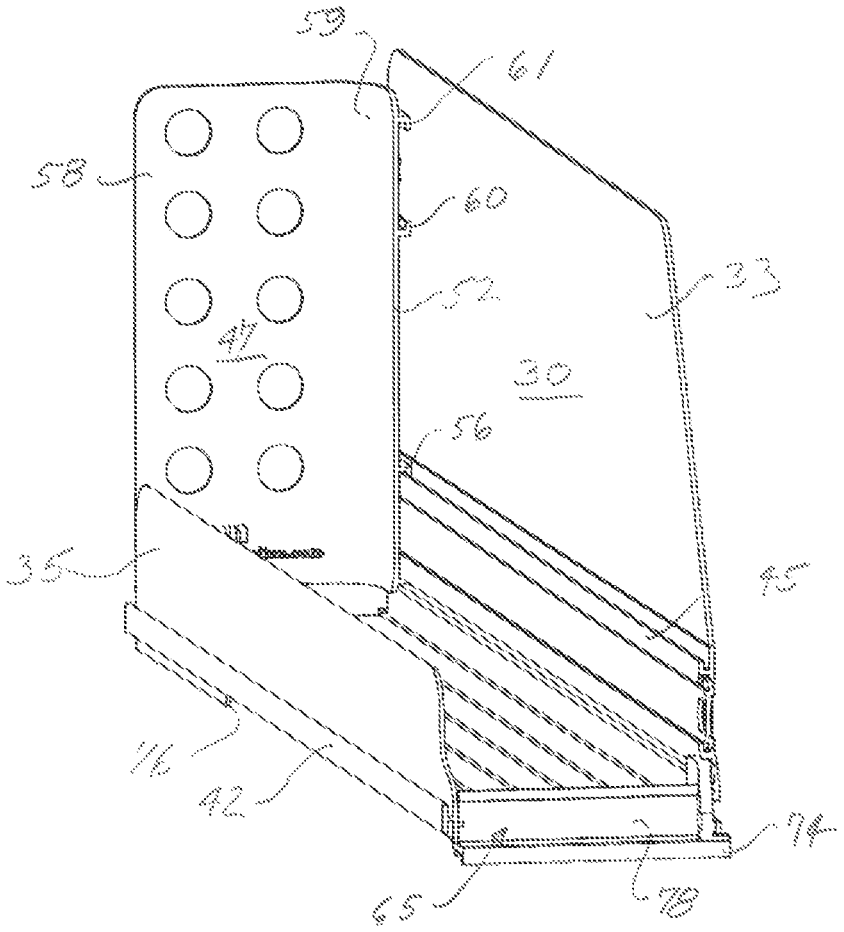
FIG. 6 is an orthographic view of a single tray according to the invention.

A significant function of the front clip 65 is to provide a limit stop to prevent excessive forward extension of a tray, when pulled forward for servicing or reloading. As can be seen in FIGS. 4 and 6, the bottom 71 of the clip 65 has a projection 74 at the right hand side which, when the clip is assembled at the front of the tray, extends slightly beyond the adjacent flanged track 43 and thus is in line with the low side wall 35 of an adjacent, connected tray. Referring particularly to FIG. 1 it will be seen that the low side wall 35 is provided, in a region below the T-shaped rail 42, with a recess 75 which extends from the front of the side wall 35 to a point spaced an appropriate distance (e.g., five inches) from the back of the tray. The height of the recess 75 is such that, when the associated tray is pulled forward, the upper margin of the low side wall 35, above the recess 75, passes over the projection 74 without interference. At the back end of the recess, however a bottom portion of the side wall 35 forms an abutment 76 which will engage the projection 74 and stop further forward movement of the tray relative to its neighboring connected tray. This assures that a pulled-out at all times has a sufficient overlap with its connected neighbors to receive adequate cantilever support from the other trays.

The clip 65 also functions to provide an inclined, front-facing surface 78 for the presentation of price and other information relating to the products displayed.

As indicated in FIG. 13, in an array of trays extending across a store shelf, the end tray on the left will not have the benefit of a second high side wall. For this reason, it is much preferred that the second (i.e., upper) bottom-forming part 36 extend from the low side wall 35 and not from the high side wall 33. When the width of a tray is adjusted to a minimum or near minimum width, the product containers are seated in a stable manner on a substantially flat bottom. However, when a tray is set to a maximum or near maximum width (FIG. 3), there can be a tendency for products, particularly if stacked in several tiers, to tilt toward the lower bottom-forming member 34. Having the high side wall 33 associated with the lower bottom-forming member 34 makes it likely that any tilting of the product containers will be properly resisted by a high side wall.

Figure 14:
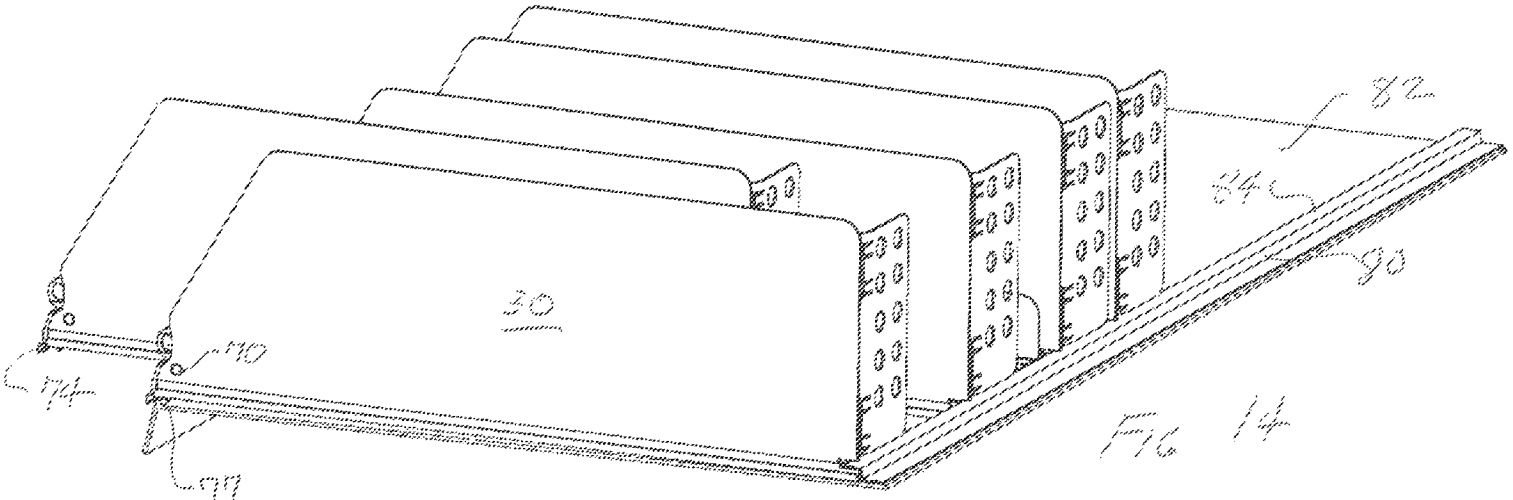
FIG. 14 is an orthographic view from the back of the assembly of FIG. 13, illustrating the assembled trays supported on a shelf.
Figure 15:
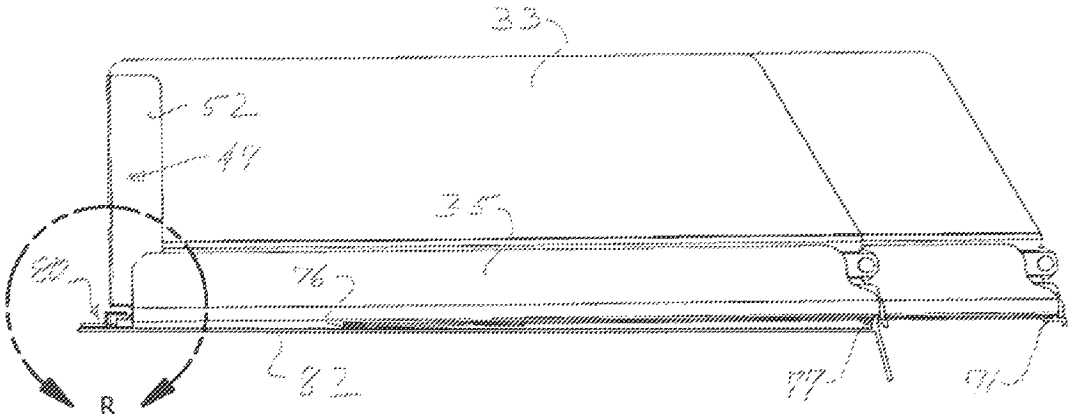
FIG. 15 is a side elevational view of the shelf-supported tray assembly of FIG. 14.
Figure 16:
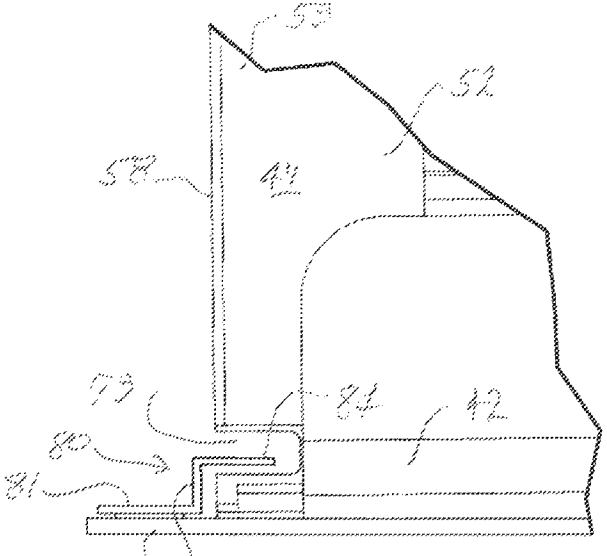
FIG. 16 is an enlarged fragmentary view of that portion of FIG. 15 identified by the encircled portion "R".
Figure 18:
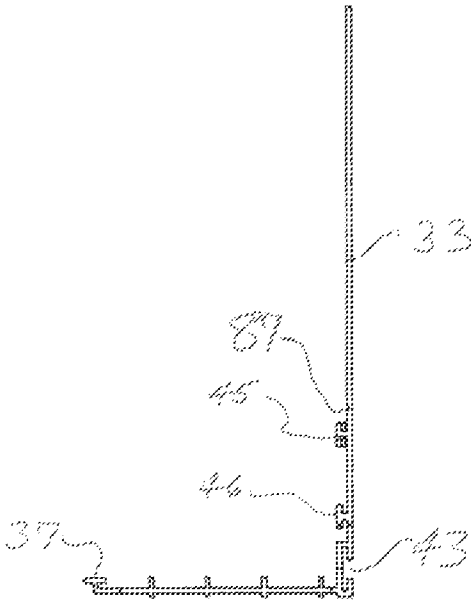
FIGS. 17 and 18 are side and front elevational views respectively of the part of the tray that forms the high side wall thereof.

In accordance with an aspect of the invention, illustrated best in FIGS. 14-16, the backs of one or both of the side walls 33, 25 may be formed with a rearwardly opening notch 79 for the reception of a retaining strip 80. The retaining strip 80 is an elongated strip which can extend along the entire length of a shelf occupied by the trays 30. The strip has a bottom portion 81 which is adhesively or otherwise secured to a shelf 82 and extends behind a group of several connected trays. A second portion 83 of the retaining strip extends upward to the level of the notches 79 and joins with a forwardly extending portion 84 which is positioned to be received within the notches 79 as indicated in FIG. 16.

A significant function of the retaining strip 80 is to prevent forward tilting of trays during servicing. Thus when a given tray is pulled forward for reloading, the resulting fully loaded tray can exert a considerable forward tilting moment on the adjacent connected trays that are providing cantilever support. If the adjacent trays were only lightly loaded, they may not adequately resist the tilting moment of the loaded tray. In such a circumstance, the retaining strip 80 will prevent upward movement of the adjacent trays and enable them to provide the necessary support for a fully loaded, pulled-out tray.

The configuration of the retaining strip 80 enables it also to serve as a barrier, to prevent positioning of a tray too far back on a shelf. Also, the retaining strip 80 can be configured to engage a series of trays in such manner as to resist free forward movement whereby, when a single tray is intentionally pulled forward for servicing, adjacent trays remain subject to resistance against such movement.

Figure 20:
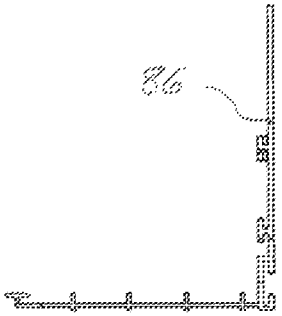
FIGS. 19 and 20 are side and front elevational views respectively of the specially modified part of a modified form of special low-height tray that incorporates a relatively low form of high side wall, for special display requirements.
Figure 19:
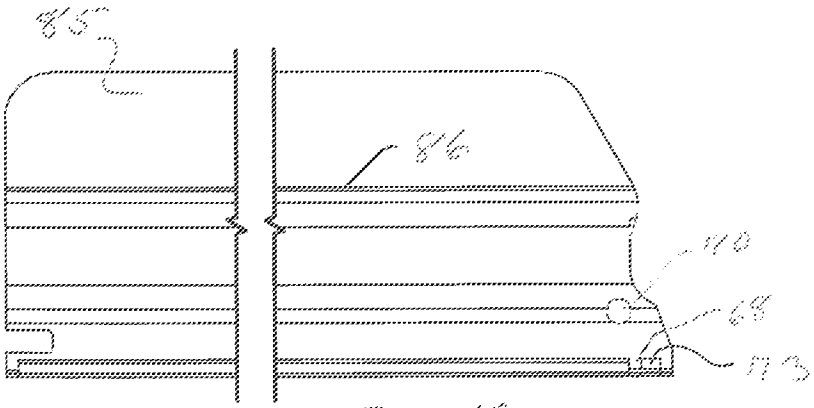

FIGS. 17-20 illustrate modified forms of tray components with modified forms of high side walls. Notwithstanding the desire for full height high side walls for most purposes, there sometimes are physical constraints in a store's shelving arrangement that prevent the use of a full height side wall. For example, there may be lighting fixtures or other structure associated with some shelves that reduce the height available to display devices. In FIGS. 19 and 20 there is shown a tray component formed with a "high" side wall 85 which is approximately half the height of the "standard" high side wall 33 shown in FIG. 17, the two structures otherwise being the same. Additionally, it may be desired to provide a notch or knife guide groove 86, 87 in the parts of FIGS. 17-20 to enable the high side walls 33, 85 of either type to be lowered to a minimum consistent with other tray structure for special store circumstances.

The system of the present invention represents a significant advance in the display and dispensing of products, such as yogurt, which is sold in a wide variety of containers of unusual shapes and sizes. The new system utilizes mostly inexpensive, extruded components, which can be easily adjusted for the expected mix of sizes and shapes. The individual trays of the new system incorporate one high side wall and one low side wall, with the low side wall being of a height slightly less than the overhang height (lip or lid) of a common product container for yogurt and like products. The trays are constructed and configured such that the low side walls are mated with the high side wall of an adjacent tray, such that each tray effectively has two high side walls. An assembly of trays of the new system will, however, utilize less material and have less overall width than an array of trays in which each tray has two high side walls.

In the new system, individual trays of a side-by-side array of many trays may be pulled forward from the array for servicing and/or reloading. The tray pulled forward is provided with cantilever support from adjacent trays in the array while servicing/reloading is carried out. Additionally, while a single tray is pulled forward, the absence of a high side wall on one side of the tray greatly facilitates access to the interior of the tray via the open side such that the necessary servicing or reloading is significantly expedited.

It should be understood, of course, that the specific forms of the invention herein illustrated and described are intended to be representative of the principles of the inventions disclosed herein and not in limitation thereof. Accordingly, reference must be made to the following appended claims in determining the full scope of the inventions.

What is claimed is:

1. A modular system for the display and dispensing of a plurality of product containers in front-to-back columns and in one or more tiers, said system comprising a plurality of individual, width-adjustable trays configured to be joined in a side-by-side array, where the individual trays each comprise:

a first extruded component comprising a first bottom-forming part and a high side wall having a first height for laterally confining product containers to be displayed in and dispensed from each tray respectively, with said product containers being stackable in a plurality of tiers, wherein the high side wall has an interior side surface and an opposite exterior side surface, wherein the high side wall is generally perpendicular relative to the first bottom-forming part, wherein the first bottom-forming part comprises an upwardly extending flanged protrusion; wherein at least one rail protrudes from the interior side surface of the high side wall, wherein a pusher is slidably mounted to the high side wall, wherein the pusher has at least one generally horizontal flange that engages the at least one rail to suspend the pusher from the high side wall, wherein the pusher is configured to move the product containers forwardly within each tray respectively;

a second extruded component comprising a second bottom-forming part at least partially overlying said first bottom-forming part and defining a product support surface and a low side wall of lower height than said high side wall for lateral confinement of the product containers between the high wall and the low side wall, the height of the low side wall being no greater than two inches above the product support surface, wherein the low side wall has an interior side surface and an opposite exterior side surface, wherein the low side wall is generally perpendicular relative to the second bottom-forming part, wherein the second bottom-forming part comprises a plurality of inverted flanged elements extending downwardly from the second bottom-forming part, wherein a channel is defined between each adjacent pair of inverted flanged elements from said plurality of inverted flanged elements;

the first bottom-forming part and the second bottom-forming part overlap and interlock with each other by inserting the upwardly extending flanged protrusion within a corresponding channel to adjust a spacing between said high wall and said low wall to a desired width for the product containers to be displayed therein;

wherein each exterior side of each high side wall and each exterior side of each low side wall have a male connector or a female connector defining a track, wherein each male connector is generally perpendicular relative to each flanged protrusion and each flanged element respectively, wherein each male connector is configured to be inserted into a corresponding female connector so that the low side wall of a first tray is slidably connected to the high side wall of an adjacent second tray, such that the high side wall of said second tray also functions as a second high side wall for said first tray.

2. The modular system according to claim 1, wherein the track of each high side wall or each low side wall is a flanged track, wherein the male connector of each high side wall or each low side wall is a flanged element;

wherein when each male connector is inserted within a corresponding flanged track the plurality of trays are secured together in a side-by-side relation with a corresponding tray being configured to move longitudinally with respect to adjacent trays from said plurality of trays to facilitate loading of said corresponding tray.

3. The modular system according to claim 2, wherein each flanged element is a longitudinally extending T-shaped rail.

4. The modular system according to claim 3, wherein each flanged track comprises vertically spaced L-shaped flange members including vertical portions joined with horizontal portions and extending toward each other defining a vertical space therebetween;

each T-shaped rail comprises a horizontal stem extending from the exterior surface of each high side wall or each low side wall and a vertically disposed outer flange portion;

each vertical space of each flanged track being substantially greater than a height of said T-shaped rail to accommodate a predetermined vertical movement of a corresponding tray with respect to an adjacent connected tray from said plurality of trays.

5. The modular system according to claim 1, wherein each first bottom-forming part is adapted to be supported on a shelf surface.

6. The modular system according to claim 1, wherein the least one rail of each high wall comprises:

a vertically spaced pair of T-shaped rails extend along the interior surface of each high side wall, in lower portions thereof respectively, each pair of T-shaped rails define a pair of outwardly facing grooves and a pair of inwardly facing grooves;

wherein the least one generally horizontal flange of each pusher comprises:

a pair of L-shaped flanges slidably engagable with each pair of outwardly facing grooves for forward and rearward sliding movement along each high side wall respectively;

wherein each pusher comprises:

an elongated pull strip having an upper edge flange and a lower edge flange, said edge flanges being slidably engaged in each pair of inwardly facing grooves respectively;

each pull strip being connected to each pusher for moving each pusher forwardly and rearwardly along each high side wall respectively.

7. The modular system according to claim 6, wherein each pusher has a body of generally L-shaped configuration comprised of a transversely disposed vertical wall and a vertical side wall disposed at right angles thereto, each pair of L-shaped flanges being mounted on each side wall near a first end of each pusher respectively, wherein each pusher comprises a second pair of L-shaped flanges being mounted on each side wall near a second end of each pusher respectively, each pusher body being rotatable from a first orientation to a second orientation to enable each second pair of L-shaped flanges to be engaged with each pair of outwardly facing grooves, each side wall extends forward when each pusher body is in the first orientation and extends rearward when each pusher body is in the second orientation.

8. The modular system according to claim 1, wherein each tray comprises a product stop member that is attached to a front margin of each first bottom-forming portion respectively for limiting forward movement of products, a projecting portion of each stop member projects laterally beyond each high side wall respectively and into alignment with a corresponding low side wall of a corresponding adjacent connected tray, wherein bottom portions of each of the low side walls of each tray are recessed from a front to a mid-section of each low side wall respectively, wherein a forwardly facing surface of each low side wall is engagable with each projecting portion of each product stop member to limit forward movement of a corresponding tray with respect to the trays connected thereto.

9. The modular system according to claim 8, wherein each product stop has a rearwardly opening slot therein for receiving an end portion of each first bottom-forming portion respectively, each first bottom-forming portion has longitudinally disposed ribs extending vertically, said ribs each have a transverse slot formed therein spaced near a forward end thereof, each product stop is inserted transversely onto each first bottom-forming member, with portions of each product stop being received in each transverse slot to lock each product stop preventing longitudinal movement relative to each bottom-forming member respectively.

10. The modular system according to claim 8, wherein a bottom portion of each product stop projects below the bottoms of each side wall to elevate front portions of each tray.

11. The modular system according to claim 10, wherein each bottom portion of each product stop is formed with a transversely extending, downwardly opening recess for the reception of a shelf guide rail.

12. The modular system according to claim 1, wherein a retaining strip is mounted on a store shelf behind the trays which are supported on said shelf, wherein said retaining strip includes a forwardly projecting portion which overlies at least a portion of the trays, wherein said forwardly projecting portion is configured to prevent forward tilting of the trays.

13. The modular system according to claim 12, wherein at least one of the side walls of each tray is formed with a rearwardly opening recess therein for the reception of portions of said retaining strip.

* * * * *